US005143502A

United States Patent [19]

Kaufmann et al.

[11] Patent Number: 5,143,502

[45] Date of Patent: * Sep. 1, 1992

[54] PAPER SHEETS BINDING APPARATUS

[75] Inventors: Rick J. Kaufmann, Los Gatos; Loren D. Stirling, Pleasanton, both of Calif.

[73] Assignee: Taurus Tetraconcepts, Inc., Mountain View, Calif.

[ * ] Notice: The portion of the term of this patent subsequent to Apr. 16, 2008 has been disclaimed.

[21] Appl. No.: 661,737

[22] Filed: Feb. 27, 1991

[51] Int. Cl.[5] ..... B42B 9/00

[52] U.S. Cl. ..... 412/16; 412/38; 412/40; 83/549; 83/571

[58] Field of Search ..... 412/40, 16, 38, 33; 83/549, 571, 618, 620, 630, 681

[56] References Cited

U.S. PATENT DOCUMENTS 5,007,782 4/1991 Groswith, III et al. ..... 412/40

*Primary Examiner*—Timothy V. Eley

*Assistant Examiner*—Willmon Fridie, Jr.

*Attorney, Agent, or Firm*—Skjerven, Morrill, MacPherson, Franklin & Friel

[57] ABSTRACT

A dual paper binding and multiple punch apparatus (10) includes a punch lever (17) operating bending blades (58) for bending flexible studs (63) of one binding strip (60) into grooves (62) on a second apertured binding strip (61) through which the studs pass after being passed through holes of a stack of apertured paper sheets. Racks (64, 69*a*, 69*b* and 69*c*) and gears (66*a*, 66*b* and 70) link the punch lever (17) to a pair of shuttles (68, 72) mounting the bending blades (58). The strips (60, 61) and paper stack (6) are first compressed by a rotory pressure bar (42) containing tangential fingers (36) cam operated by a slide bar (51) by manual movement. A cover (16) encloses the compression and stud bending mechanisms when not in use and is extendible to form an additional platen (23*a*) to support the paper stack (6) being bound.

32 Claims, 8 Drawing Sheets

PAPER SHEETS BINDING APPARATUS

CROSS-REFERENCE TO RELATED APPLICATION

This application relates to U.S. application Ser. No. 07/381,612 filed Jul. 18, 1989 entitled Combined Paper Punch and Binding Apparatus now U.S. Pat. No. 5,007,782 issued and assigned to Applicants, assignee The disclosure of such U.S. application is incorporated herein by reference.

BACKGROUND OF THE INVENTION

1. Field of the Invention

This invention relates to an apparatus for punching and binding a stack of margin punched hole paper sheets where binding elements enter through the punched holes. More particularly the invention is directed to a binding apparatus with additional capabilities than that apparatus disclosed in the related application including a binding station for so-called Velobind ® PVB binding strips (Personal VeloBinder). The PVB binding utilizes a front strip having a series of typically six projecting flexible studs which pass through a margin apertured (typically six holes) paper sheets stack and through a six hole back strip. The projecting ends of the studs are bent about 90° into a series of six holding grooves on the backside of the back strip between the strip holes. U.S. Pat. Nos. 4,674,906 and 4,685,700 exemplify the PVB-type binding strips per se.

Additionally the invention relates to an improved mechanism for clamping an assemblage of binding strips and a paper sheets stack and an improved binding station utilizing a Douvry-type binding element (U.S. Pat. Nos. 1,970,285 and 2,257,714) in the apparatus of the related application.

In the related application it was contemplated that the dual or triple punch mechanisms disclosed would be used with a Douvry-type binding in one binding station and with a Velobind ® binding of the cut-off and upset stud type in a second binding station. That earlier type of Velobind binding is seen in U.S. Pat. Nos. 4,354,783 and 4,369,013.

2. Related Art

A bending apparatus for bending the PVB-type of binding strips is seen in U.S. Pat. No. 4,906,157 where a pivoted lever arrangement moves a pair of blocks carrying rollers, with each block moving inward toward the center upon lever actuation to bend and snap the projecting ends of the flexible studs simultaneously into the back strip grooves. Other roller mechanisms have been proposed to bend the projecting end studs into the grooves. Initially in early commercialization, the bending of the stud projecting ends was accomplished by manual bending.

Further it has been contemplated that a pressure bar may be employed for compressing a pair of binding strips with a paper sheets stack therebetween as exemplified by U.S. Pat. No. 4,354,783. In other devices a vertically movable motor-driven pressure bar is provided driven through racks and rollers fitting in side plate slots. These devices also include a stud bending mechanism having drum cams, transverse rods, and a pair of carriages with rollers which bend the projecting stud ends so that they snap into the strip grooves. This is seen in U.S. Pat. No. 5,015,138 issued May 14, 1991.

In another stud bending machine U.S. Pat. No. 5,017,071 issued May 21, 1991, provision is made for moving and clamping female strips and bringing them into contact with a paper sheets stack. A male strip with the projecting studs is moved upwardly to pass through the stacked paper apertures and the holes in the female strip. A crank shaft is turned and legs of a closer plate bends and depresses the projecting stud portions. A carriage is then moved to its loading position for the next cycle of operation.

One of the difficulties of the above machines is the care one must take to avoid improper loading of the strips. Such improper loading may damage the machine if the female strip is placed upside down and there is no downwardly-facing series of grooves to accept the bent studs ends. In such event the bent studs would have no space to move and the machine would be subjected to stresses and deformation which may cause permanent damage. Further, it is clear that the prior art stud bending machines are independent stand-alone items and have no capability of punching holes in a stack of paper sheets nor any capability of providing for other binding elements such as a Douvry-type binding:

U.S. Pat. No. 3,967,336 (Cutter) shows a punch lever for shifting and operating a Douvry-type binding mechanism. U.S. Pat. No. 3,122,761 shows a rotory lever for operation of a hook plate containing diagonal slots.

SUMMARY OF THE INVENTION

The apparatus of the present invention is used in binding a stack of punch hole paper sheets with either a Douvry-type binding element or Velobind PVB-type binding strips as desired. It does so in combination with a machine in which holes of various sizes and shapes may be punched in a stack of paper selects using a common pivoted lever or crank. The present invention utilizes that same crank to effect the bending of a binding element portion, i.e. the projecting stud ends of the PVB first (male) strip into grooves in the PVB second (female) strip. Further, novel means built into the machine on opposite sides of the machine housing provides an improved mechanism for uncurling the Douvry-type binder curled fingers and a simple mechanism for clamping the PVB strips and paper sheets stack prior to the bending of the projecting stud ends. Both these mechanisms are finger-operated through parallel, coextensive platen slots juxtaposed on opposite sides of the housing immediately adjacent to and below fixed platen surfaces. The fixed platens are adjacent the opposite linear edges of the housing through which marginal edges of sheets of paper are inserted to be punched.

A pivoted cover as described in the related application covers the Douvry-type binding station when not in use and a pivoted cover encloses the PVB-type binding station when not in use. The latter is a two-part cover which folds out from the housing and provides a platen extension to support an inward portion of the stack of paper sheets in a horizontal plane as the stack and the strips are being compressed and the studs projecting ends are being bent.

A bending mechanism is provided including a vertically moving rack pivotally connected to the punch lever or crank, and a pair of spur gears on a shaft, with one spur gear interconnected to a shuttle rack converting rotary motion to linear motion of the shuttle. The shuttle mounts a series (typically six) bending blades each with one or more camming surfaces which bend the stud ends. The bending blades are bifurcated so that in the event a female strip is placed upside down in the machine the upper part of the bending blades in last contact with the stud ends can flex downwardly if there is no groove present in the underside of the female strip in alignment with the bend path. This permits flexing of the bending blades upper parts and prevents any damage to the machine.

The compression clamping of the strips and paper sheets stack in the machine is provided by a slide bar extending within a platen slot, the slide bar having a pair of fixed cam followers extending laterally therefrom. A rotary pressure bar is journalled in the housing and has a series of fixed tangential fingers contacting, when rotated, the top of a top, male stud-containing strip so as to compress that strip against the paper sheets stack and the female back strip. The pressure bar is normally split in two parts with each part containing a 45° spiral cam channel engaged respectively by the pair of cam followers on the slide bar. Lateral movement of the slide bar by an operator's finger movement rotates the pressure fingers to compress the binding assemblage.

An improvement in the operation of the hook plate of the Douvry-type binding station includes a finger-operated sliding block in the housing accessed through a platen slot which block moves laterally along a square rotating rod having fixed spur gears on each end to ensure uniform parallel movement of the hook plate. An essentially flat plastic hook plate includes an angular camming groove extending along a top surface into which extends a cam follower integrally fixed to the sliding block, such that as the block moves linearly, the hook plate moves linearly in a direction orthogonal to the block movement. Motion of the hook plate thus uncurls the Douvry-type curled fingers (the binding element portion) so that the fingers can receive the apertures of the stack of paper sheets. Reverse movement of the sliding block by the operator's manual movement of a block slider allows the fingers to recurl completing a booklet binding.

DETAILED DESCRIPTION

Figure 1:
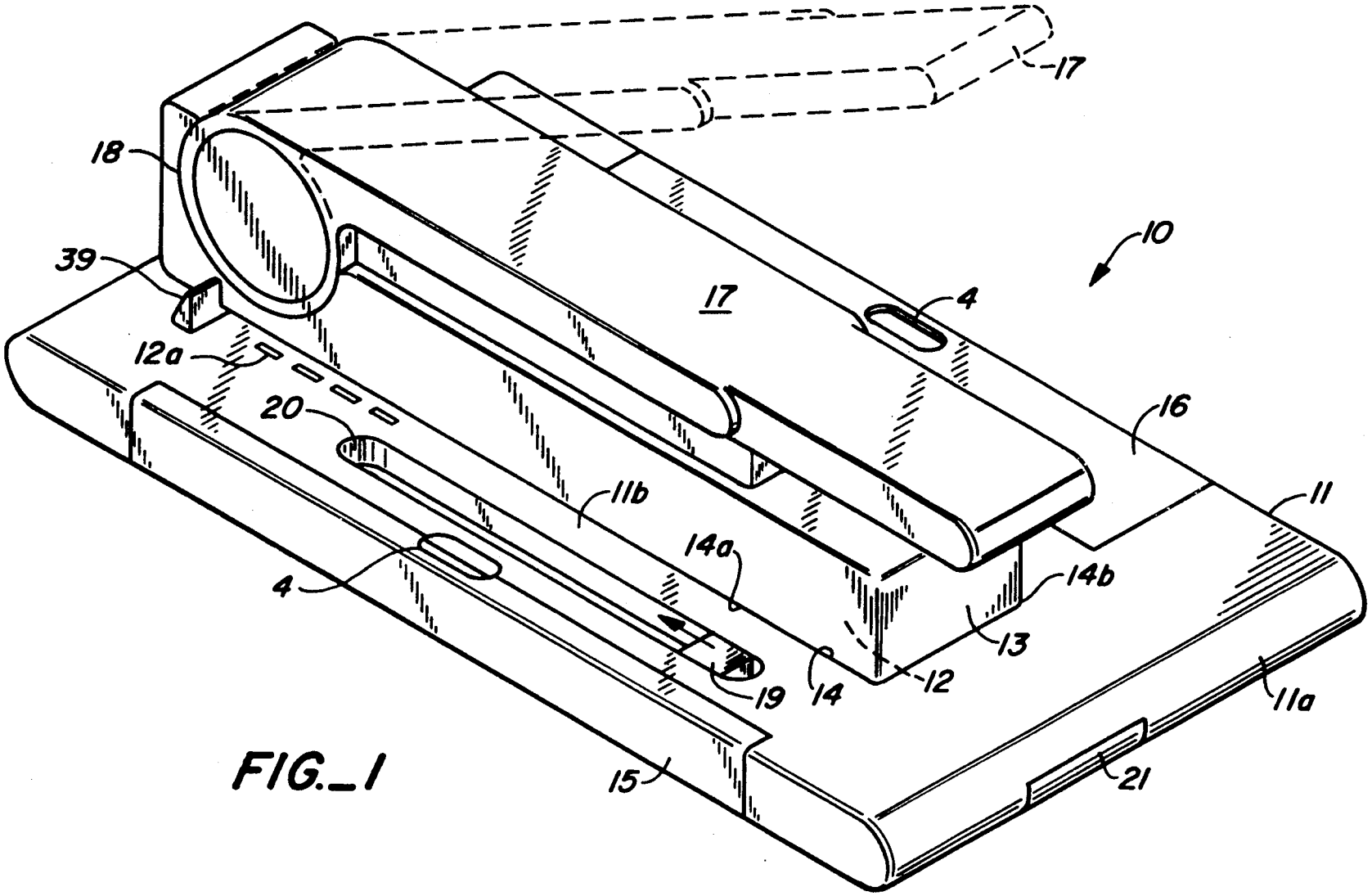
FIG. 1 is a perspective view of the apparatus housing showing closed binding stations and the pivot motion of the operational punch crank.

A combined dual or triple paper punch and dual binding station apparatus 10 is seen in FIG. 1 where a housing 11 is placed on a horizontal work surface (not shown). The housing comprises a lower base portion 11*a*, and a substantially central upper housing 13 containing punch mechanisms 12. Linear paper stack entry edges 14 on opposing bottom edges of the upper housing permit entry in horizontal slots 14*a* and 14*b*, formed between edges 14 and the top surface 11*b*, of base portion 11*a* of a various number of paper sheets making up stacks 5 and/or 6 of paper sheets as seen in a prior art FIG. 12. Indicia 12*a* printed on surface 11*b* indicates the number, shape, spacing and size of the punch holes to be punched in a marginal edge of the particular paper sheets stack. Rectangular holes are illustrated for a Douvry-type binding. Round hole indicia 12*a* are employed (FIG. 2) adjacent to the opposite paper slot 14*b*.

The punch mechanisms 12 are simultaneously operated and have a common drive linkage and two parallel punch systems to punch holes in an inserted stack by downward movement of a crank or lever 17 extending parallel to the housing major longitudinal axis and pivoted in a housing cavity 18 with respect to the housing 11. Stack guides 39 assist in guiding a paper stack into one or both the slots 14*a* or 14*b*.

Housing base 11*a* houses a pair of binding stations which in non-use are enclosed by covers 15 and 16, respectively. In the illustrated embodiment, a binding station for a Douvry-type binding is under cover 15 and a VeloBind PVB-type binding station is under cover 16. A pair of elongated slots 20 and 32 extending parallel to lever 17 and the housing major longitudinal axis provide access to finger-operated slides 19 and 31 to provide for execution of particular binding steps in the binding stations to which they are associated. Thumbnail depressions 4 provide for easy opening of covers 15 and 16.

Figure 2:
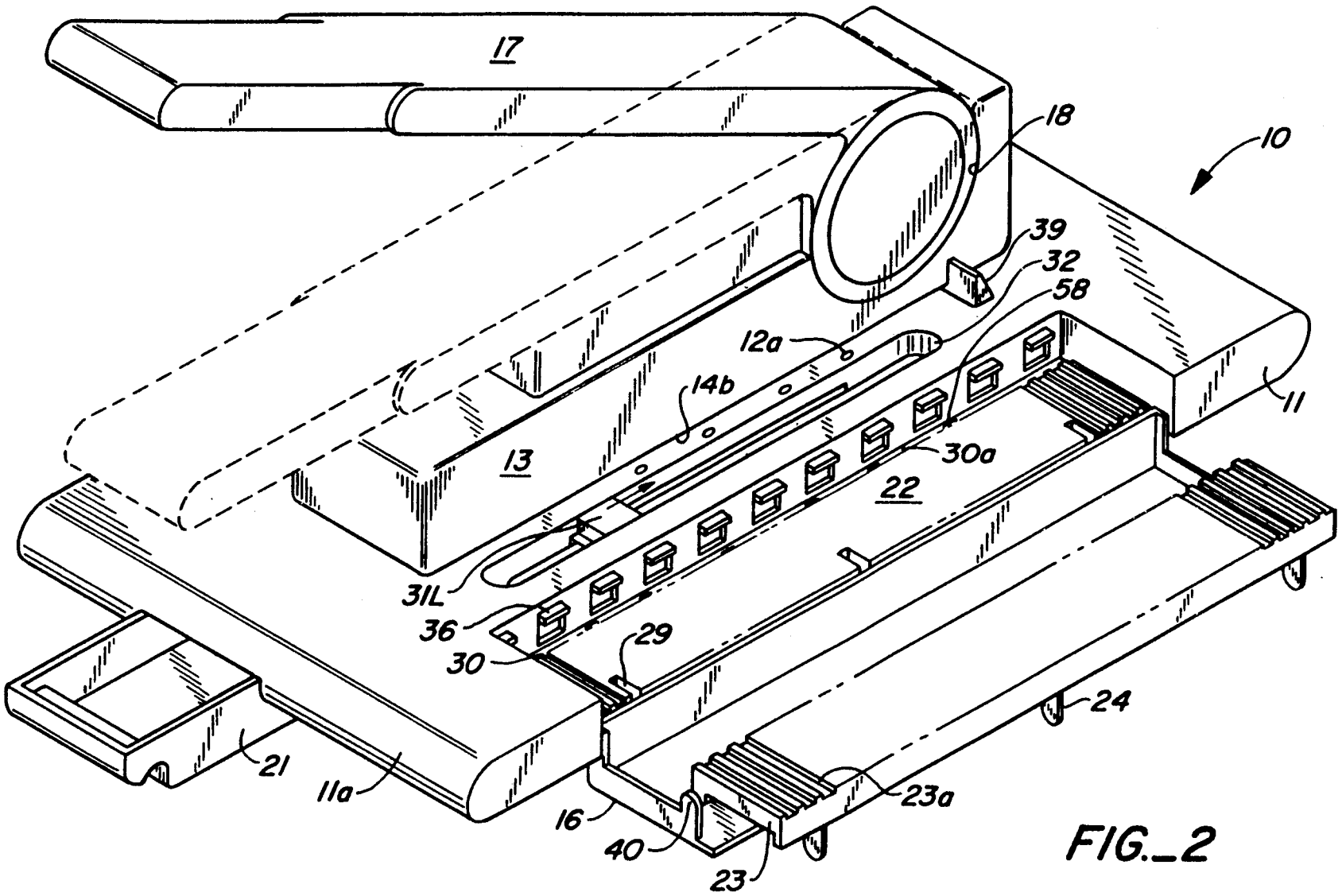
FIG. 2 is a perspective view of the apparatus showing a punch-out trash drawer for paper punch-outs and a two-strip flexible stud binding station with the cover platen folded out and the binding assemblage compression mechanism in the Up position.

FIG. 2 illustrate the opposite side of the overall apparatus with cover 16 in an open extended condition exposing a recess 30 for introduction of an apertured PVB-back or female strip and pressure fingers 36 for clamping both PVB-strips and a paper sheets stack therebetween in the binding station. In this illustration slide operator 31 is seen in the 31L (Left) position and the pressure fingers 36 in the Up (non-clamping) position . Opening of pivoted cover 16 exposes a fixed platen portion 22 and further pivoting of cover extension 23 around pivot 40 exposes an extended platen 23*a*. The two platens provide support for over half the width of a paper sheets stack inserted for binding into the female strip in recess 30. Bending blades 58 to effect bending of the PVB studs extend upwardly within slots 30*a* at the bottom of recess 30. The outer cover extension 23 contains support legs 24 which rest on the apparatus support surface in the extended position and rest in slots 29 in the fixed platen in a cover 16 closed position. A trash drawer 21 extending to a position under the punch mechanisms in upper housing 13 for reception of the punched-out centers of the holes formed in the paper sheets from action of the paper punch mechanisms, is slidable out from the end of base portion 11*a* for dumping.

Figure 3:
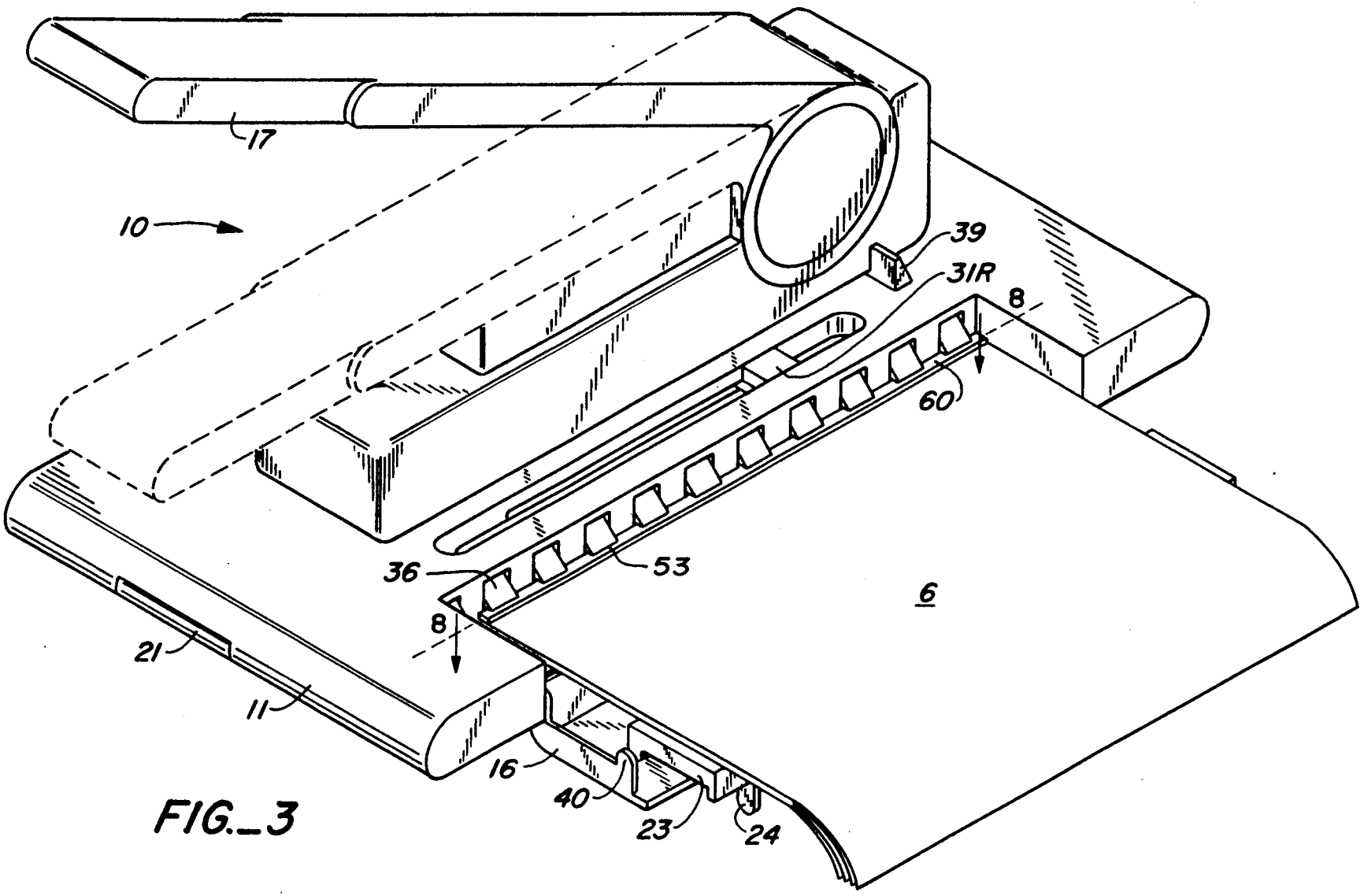
FIG. 3 is a perspective view of the apparatus showing a booklet in clamped and platen-supported position and the punch crank in Up position before pivoting downward to a dash Down position causing bending of the stud ends into the back strip grooves of the PVB binding.

As seen in FIG. 3 movement of slide operator 31 to the right (31R) functions to move pressure fingers 36 downward to effect clamping of the binding elements and the paper sheets stack. The ends 53 of the cantilevered pressure fingers 36 in the Down position contact the top of top (male) strip 60 of the PVB binding with the degree of clamping being dependent on the thickness of the paper stack 6 and the amount of "Right" movement of slide operator 31. Movement of the bending blades 58 is provided by movement of the punching lever 17 downwardly to the dash position in FIG. 3.

Figure 4:
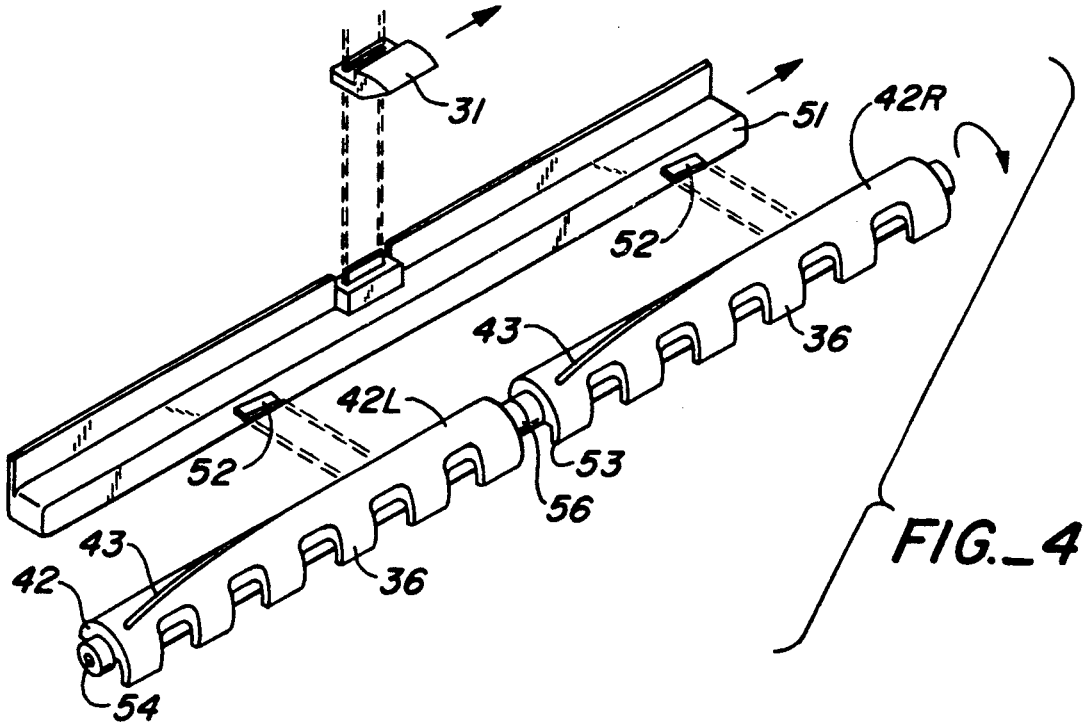
FIG. 4 is an exploded perspective view of the strips clamping mechanism.
Figure 8:
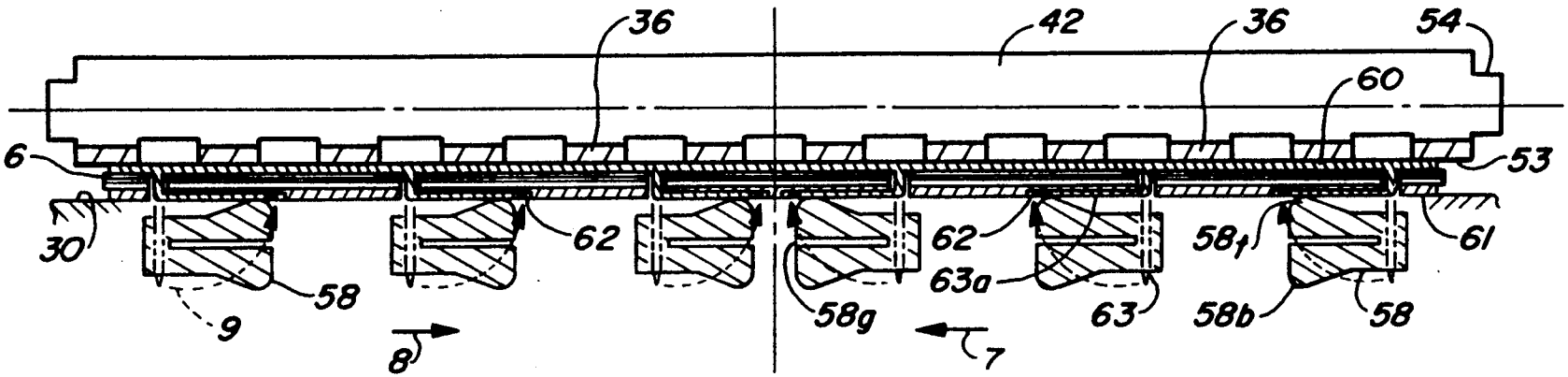
FIG. 8 is a cross-sectional view of the clamping pressure bar, binding strips and paper sheets stack taken on the line 8—8 of FIG. 3.

FIG. 4 illustrates the clamping mechanism in detail. Slide operator or knob 31 is press-fitted into a slide bar 51 which slides laterally on a support surface (not shown) in lower housing 11*a*. A pair of tang-type cam followers 52 extend outwardly from a vertical edge of the slide bar. A half-round cylindrical rotory pressure bar 42 is juxtaposed to slide bar 51 and includes a central shaft 54 rotatively journalled by suitable end bearings (not shown) and a central bearing 56. A pair of plastic, typically glass-filled nylon, finger segments 42L and 42R each containing a spiral camming channel 43 and a series of tangential cantilevered pressure fingers 36 are mounted on shaft 54. The cam followers 52 on the slide bar 51 move in the camming channels 43 such that movement of slide bar 51 to the right rotates the fingers downwardly to compressively clamp the binding elements 60 and 61 and paper stack therebetween together prior to bending of the extending studs of strip 60 extending beyond strip 61 (FIG. 8).

Figure 5:
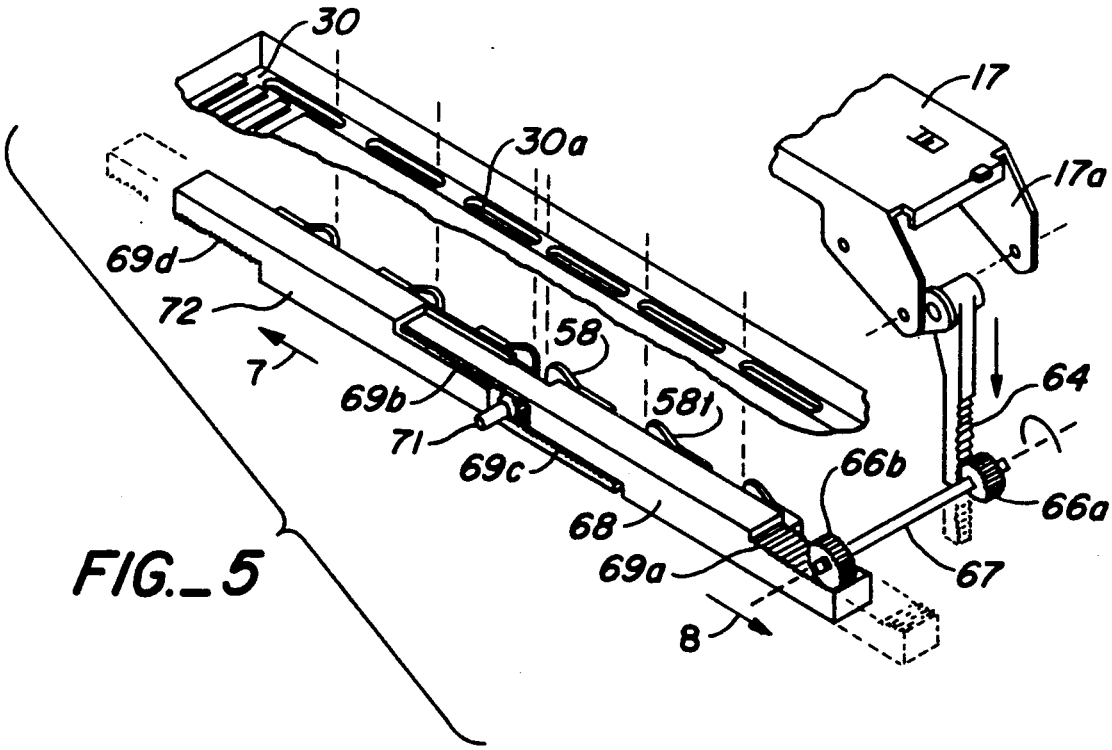
FIG. 5 is an exploded perspective view of the stud bending mechanism.
Figure 6:
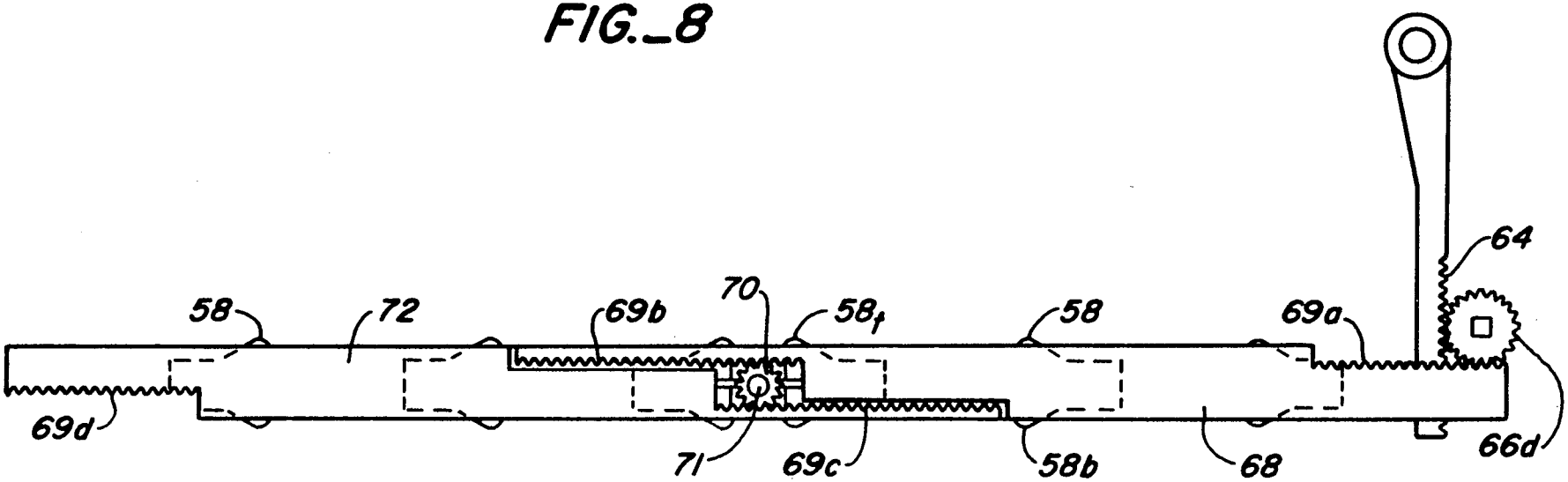
FIG. 6 is an elevational view of the spur gear-to-shuttle rack connection.

FIG. 5 and 6 illustrates the construction and operation of the bending blades 58 particularly the movement of the blade top tips 58*t* in slits 30*a* at the bottom of recess 30 into which strip 61 is to be placed. Bending blades 58, six in number for a six-stud binding strip, extend preferably integrally in groups of three from a pair of shuttles 68 and 72. The shuttles are driven by a gear and rack train comprising a vertically-movable rack 64 pivotably attached to lever support flanges 17*a*, the rack 64 being in engagement with a spur gear 66*a* fixed to shaft 67, a second spaced fixed spur gear 66*b* on the shaft 67 interconnecting to an upwardly-facing rack 69*a* at one end of the first shuttle 68 which has a second end rack 69*b* facing downwardly in engagement with a spur gear 70 rotatable with shaft 71, which gear 70 is also engaged with an upwardly-facing end rack 69*c* on the inner end of second shuttle 72. While a rack 69*d* is seen on shuttle 72 it has no function except to make the two shuttles common parts for cost savings. The resultant shuttle motions are in opposite directions toward the outer-ends as indicated by the arrow 7 & 8 so that the three bending blades 58 on shuttle 68 move to the left to bend three studs and the three bending blades on shuttle 72 simultaneously move to the right to bend the other three studs.

The bending blades 58 are bifurcated including the blade top 58*t* and a blade bottom 58*b*. A space therebetween in the form of a U-shaped horizontal groove 58*g* is provided so that blade top 58*t* can flex downwardly in the event that female strip 61 is inserted into recess 30 in an upside down orientation where there is no strip groove 62 to receive a 90° bent stud. The groove 58*g* has sufficient depth to accommodate the resulting flexing and prevents damage to the overall apparatus.

Figure 7:
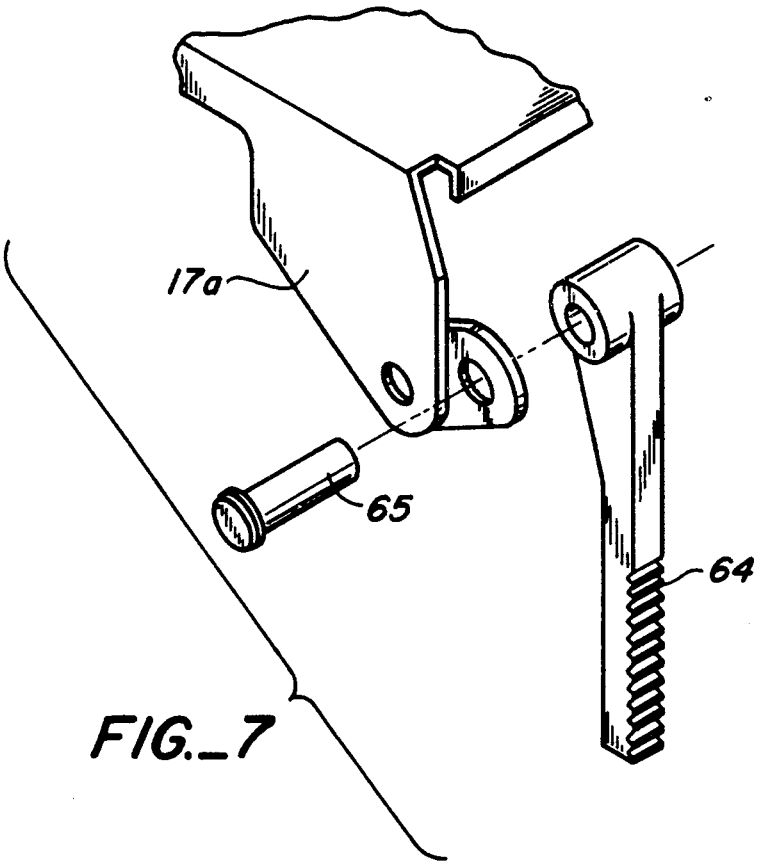
FIG. 7 is a perspective view of the crank-to-vertically movable rack connection.

FIG. 7 shows the connection of rack 64 to the lever support bracket 17*a* by a pivot pin 65.

FIG. 8 illustrates the clamping of the strips 60 and 61 and paper stack 6 between the pressure fingers 36 and the bottom of recess 30. After the pressure bar 42 has been rotated by manual linear movement of the slide operator 31 and resultant linear movement of the slide bar 51, pressure fingers 36 compress the strips and paper stack into a clamped condition. Lever 17 is then pivoted downwardly-moving the two shuttles (FIG. 5) and the bending blades affixed thereto. This is seen in FIG. 8 where three bending blades move to the left (arrow 7) and three blades move to the right (arrow 8) to effect bending (arrow 9) of each of the studs 63 of top strip 60 extending straight through the apertures in back strip 61 into a 90° bent position 63*a* in back strip grooves 62. As each bending blade advances against a straight stud both portions 58*b* and 58*t* initially contact the outboard and inboard portions, respectively of the studs. Immediately as shuttle motion continues only top tip portion 58*t* is in contact with its respective stud and the full travel of the shuttle and bending blades moves the stud ends in the trajectory of arrow 9 into strip grooves 62 where they are snapped into the grooves as in the U.S. Pat. No. 4,685,700 type binding.

Figure 10:
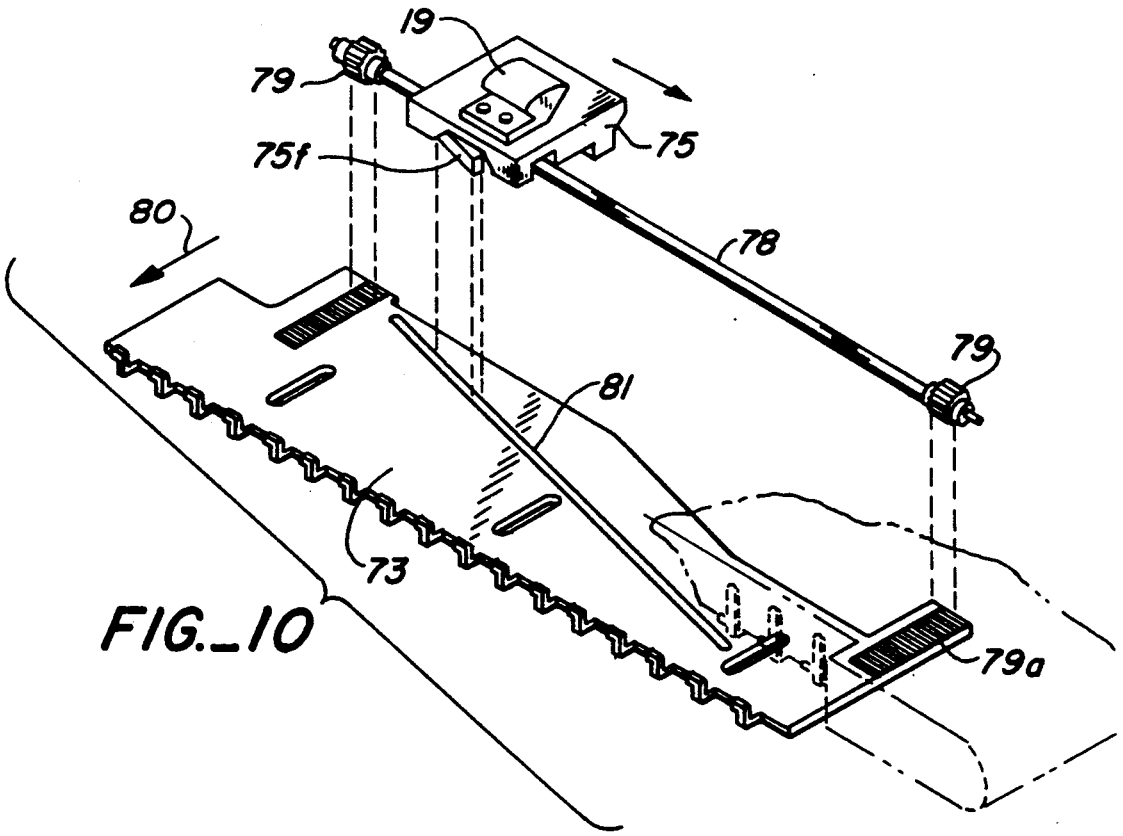
FIG. 10 is an exploded perspective view of a slide block-to-hook plate connection.
Figure 9:
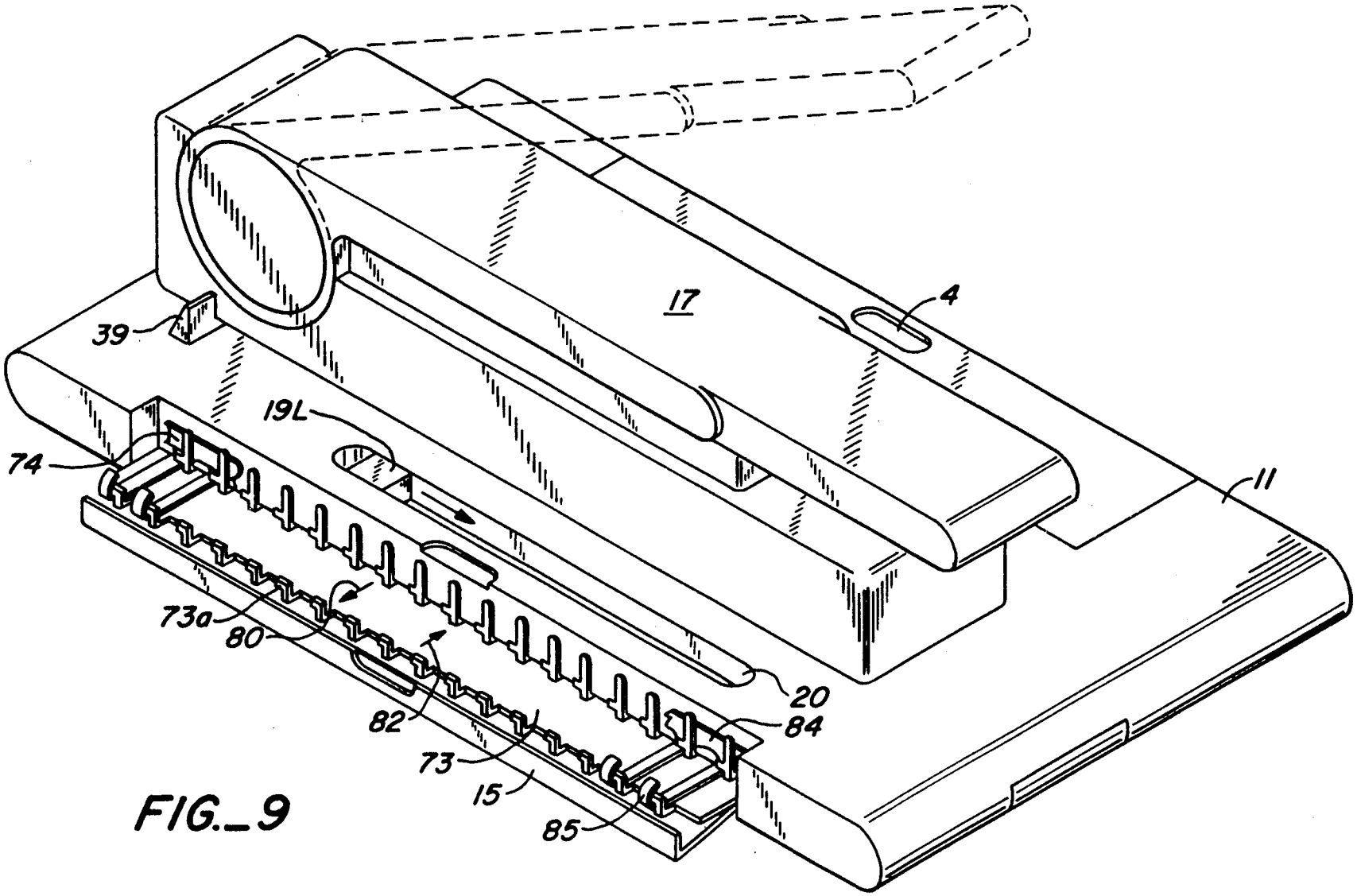
FIG. 9 is a perspective view of the Douvry binder-type binding station showing an extended hook plate and a segment of the looped binding.

FIG. 9 and 10 illustrate an improved Douvry-type binding station in which a slide operator or knob 19L (L standing for the left position) accessed in a slot 20 in the platen surface 11*b*, is connected to a slide block 75 movable on a square rotating shaft 78 having a fixed spur gear 79 at each end interconnecting with racks 79*a* on a hook plate 73 to ensure parallel movement of the hook plate. An integral follower 75*f* extends from the bottom of slide block 75 and rides in an angled horizontal slot 81 in hook plate 73 such that manual linear movement of slide operator 19L to the left results in orthogonal outward movement of plate 73 as indicated by arrow 80. The Douvry-type binding unit includes curled binding fingers extending integrally from an elongated spine 84 which fingers are captured by plate hooks 73*a* and uncurl to allow receipt of a stack of rectangularly apertured paper sheets on the uncurled finger ends 85. Movement of the operator 19 to the right moves the plate inwardly as indicated by arrow 82 allowing the binding fingers to recurl, binding the stack at its side margin as known in the prior art.

Figure 11:
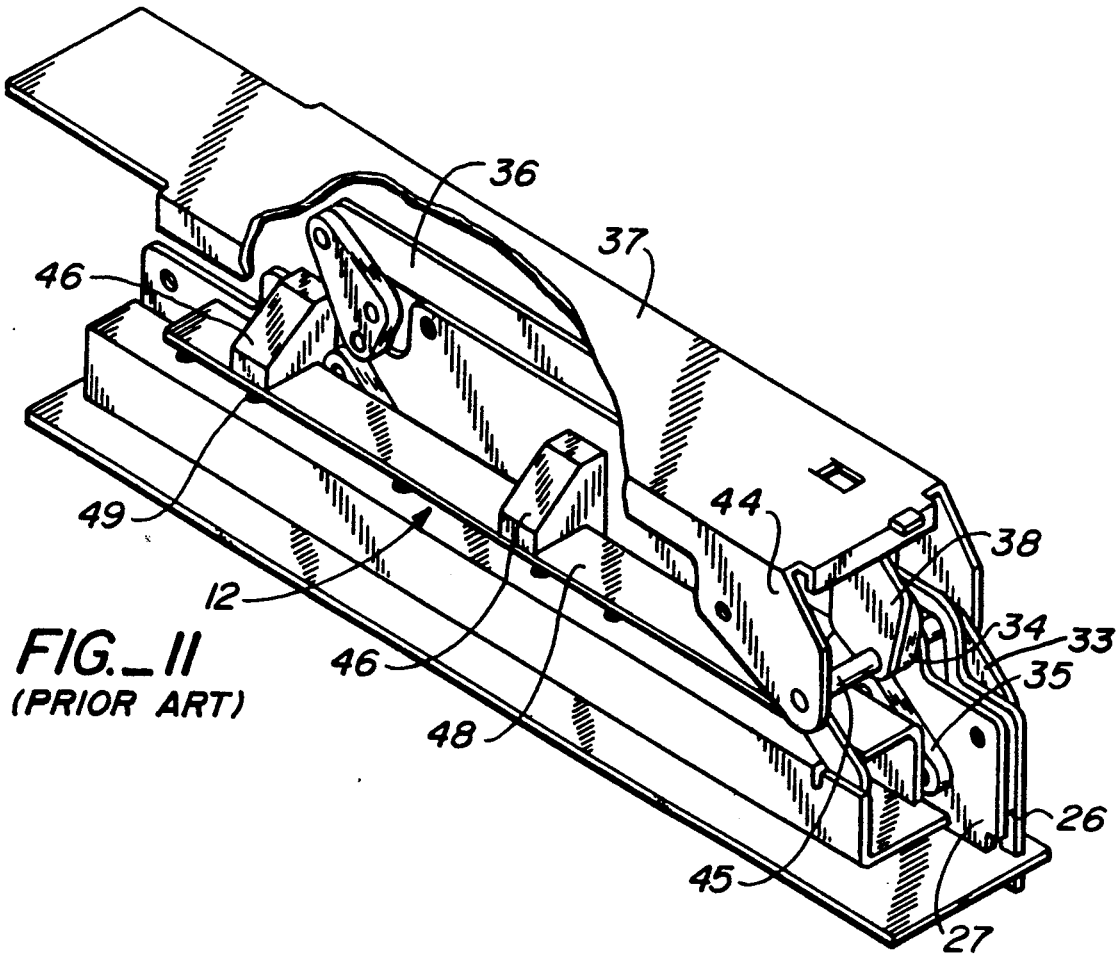
FIG. 11 (PRIOR ART)
FIG. 11 is a prior art cutaway perspective view of a round hole punch after stroke completion showing the lever connection to the housing.
Figure 12:
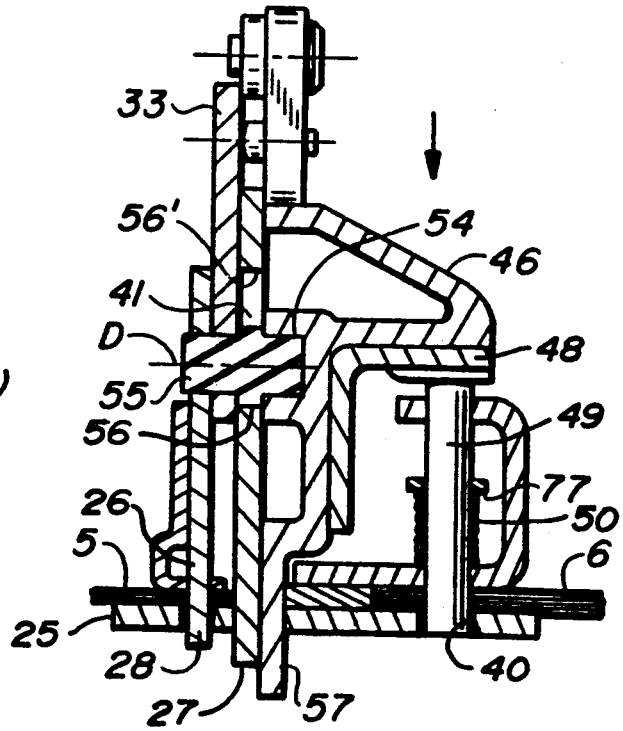
FIG. 12 (PRIOR ART)
FIG. 12 is a prior art cross-sectional view of the punch mechanism upon completion of a lever-operated punching stroke.

FIG. 11 taken from the related application illustrates the lever linkage which operates the punching mechanisms. The punching mechanisms per se do not form any part of the present invention other than that the punching lever also is utilized as illustrated in FIGS. 5–7 to operate the stud bending blades. As seen in FIGS. 11 and 12 the point D represented by pin 55 extends through slot 41 in vertical plate 27 and is movable vertically with respect to the lower and upper slot edges 56 and 56', respectively. One end of pin 55 is fixed in punch plate 26 and the other end is fixed in a socket 54 in a vertically movable bracket 46. Interposed under the bracket 46 is a round punch actuator angle bar 48 which contacts the top of punches 49 extending vertically aligned with selected ones of the round hole apertures 40 in the die plate 25. Punches may be provided in two, three or four and/or the six positions for the PVB-type of binding punch positions depending on the number and location of round holes desired in the paper sheets stack. A series of return springs 50 are provided within a punch housing, the tops of the punches 49 extending out from a top surface of the housing. Collars 77 such as a snap-ring are affixed to punches 49 which function to compress an associated spring 50 when the punch is driven downwardly. Upon raising the lever the pins are returned by the spring expansion so that the punch tops extend above their housing. Alternatively, the punches can be manually retracted by extension of bar 48 engaged beneath collars 77 in lieu of springs 50.

FIG. 12 illustrates the positioning of a marginal edge of a paper sheets stack 6 which has been guided into the proper position over and above an edge of die plate 25. The lever 17/37 is shown in the "down" position and pin 55 is at slot edge 56 and at its furthest position from slot edge 56'. Upon the downward activation of the lever, pin 55 (and point D) moves down in a vertical straight line simultaneously driving both punch plate 26 and bracket 46 down so that both the rectangular punch elements 28 on the punch plate and the driven round hole punches 49 shear out rectangular holes and round holes, respectively, in paper sheets stack 5 and paper sheets stack 6, if in fact a stack has been inserted in both punch mechanisms 12 of the overall apparatus. The brackets 46 also contain a bottom tail portion 57 which slidably guides the brackets through apertures on die plate 25 and past abutting fixed vertical plate 27.

FIG. 11 also shows the four-bar linkage of the related application which affords a straight-vertical line punching stroke resultant from pivot movement of lever 17 and its internal support 37. The four bar linkage includes a coupler plate 33, a link 34, a crank lever extension 38, connected to a short link 35 (rocker arm), and long link 36. Pin 45 connects the lever support side sections 44 to extension 38 and link 34.

The above description of an embodiment of this invention is intended to be illustrative and not limiting. Other embodiments of this invention will be obvious to those skilled in the art in view of the above disclosure.

We claim:

1. Apparatus for punching and binding a stack of paper sheets including an apparatus housing;

a punch mechanism in said housing including hole punch elements accessible to paper sheets insertable along a linear edge of said housing;

a punch operational means connected to said housing for actuating said punch mechanism;

means interconnecting said punch operational means to said punch elements for punching apertures in paper sheets inserted into said punch mechanism at said linear edge;

binding means in said housing for binding a stack of apertured paper sheets; and wherein said binding means comprises recess means for accepting a first binding strip having a series of holes generally corresponding in size and spacing to the apertures in a paper sheets stack placed thereon;

means for accepting a second binding strip having flexible studs projecting therefrom of a size and spacing generally corresponding to the holes in the first binding strip, the studs passing through the apertures in the paper sheets stack and through the first binding strip holes, with ends of the studs projecting from the first binding strip; and bending means in said housing for bending the stud ends, said bending means comprising at least one bending blade positioned below the first binding strip and being laterally movable to bend each projecting stud ends into an underside stud-holding groove in said first binding strip; and means for connecting said at least one bending blade to said punch operational means, motion of said punch operational means resulting in movement of said at least one bending blade.

2. The apparatus of claim 1 wherein said means for connecting comprises a vertically moving rack pivotally connected to said punch operational means, a first shuttle including a rack connected to said vertically moving rack and mounting one-half of a series of bending blades to move laterally in a first horizontal direction and a second shuttle including a rack gear-connected to said first shuttle rack for mounting a second one-half of said bending blades to move in an opposite second horizontal direction.

3. The apparatus of claim 2 wherein said vertically moving rack is drive connected to a first spur gear, said first spur gear being coupled to a second spur gear in drive-connection with said first shuttle rack.

4. The apparatus of claim 3 in which said first shuttle includes a first end rack drivable by said second spur gear, and a second end rack, aid second shuttle having a third end rack spacially aligned with said second end rack and a drive gear between said second end rack and said third end rack for transferring lateral directional motion of said first shuttle into opposite lateral directional motion of said second shuttle.

5. The apparatus of claim 1 including a series of bending blades and in which said bending blades are bifurcated such that an operative bending portion will flex downwardly in the event that the first binding strip is misplaced in said recess means.

6. The apparatus of claim 5 in which a top portion of each of said bending blades includes a cam surface for bending each projecting stud end into the first binding strip groove.

7. The apparatus of claim 1 further including means in said housing for pressing the second binding strip against the paper sheet stack and the first binding strip to compressively hold the binding strips and stack while said at least one bending blade is being moved to bend the projecting stud ends.

8. The apparatus of claim 7 in which said pressing means comprises a rotary pressure bar having at least one fixed finger contactible with the second binding strip, a slide operator extending in a slot in said housing, said slide operator including at least one cam follower, said pressure bar including a surface spiral cam channel, said at least one cam follower being engaged with said cam channel such that lateral movement of said slide operator rotates said pressure bar and moves said at least one finger downwardly against the second binding strip.

9. The apparatus of claim 8 wherein said slide operator includes a slide bar having an upstanding operating knob, said at least one cam follower extending from said slide bar.

10. The apparatus of claim 9 in which said operating knob is juxtaposed to and below said housing linear edge.

11. The apparatus of claim 8 including a pair of spaced cam followers; a split pair of a series of fixed fingers extending from said pressure bar, each split pair having a surface spiral cam channel receiving respectively one of said pair of cam followers; and bearing means extending between said split pair of the series of fixed fingers.

12. The apparatus of claim 8 in which at least one fixed finger extends tangentially from said pressure bar.

13. The apparatus of claim 8 in which said pressure bar comprises an essentially half-round cylindrical bar extending around a central shaft and a series of fixed, inflexible spaced fingers tangentially extending from an edge of said half-round bar, said cam channel being located on a remainder of said half-round bar and along a lateral portion of said half-round bar.

14. The apparatus of claim 1 further comprising foldable-out platen means extending from an edge of said housing for supporting the stack of paper sheets, said platen means including means for covering said recess means and said at least one bending blade when said binding means is not in use.

15. The apparatus of claim 14 in which said platen means comprises a fixed platen coextensively juxtaposed to said recess means, a rotatable cover door and a hinged platen extension pivotable with respect to said door and storable in the interior of said cover door, said cover door and platen extension being pivotable with respect to said housing into a position atop said fixed platen to enclose said binding means, and wherein in open position said fixed platen and said platen extension support the paper stack during assembly of said binding means.

16. The apparatus of claim 1 further comprising:

a platen extending outwardly from an outer-edge of said recess means, a vertical wall in said housing extending upwardly from an inner edge of said recess means;

said vertical wall having a series of wall apertures therein; and means, including a series of rotary pressure fingers each extending through one of said series of wall apertures, for compressively holding said binding strips and paper sheet stack in said recess means.

17. Apparatus for binding a stack of perforated paper sheets utilizing flexible studs projecting from a first strip placed on one side of a marginal edge of the paper sheets stack wherein the studs pass through the sheet perforations and project through holes in a second strip placed on the opposite side of the marginal edge of the paper sheets stack comprising:

a housing;

means in said housing for supporting an assemblage of the strips and the paper sheets stack with the second strip being supported by said housing;

clamping means for clamping the assemblage to said housing; and bending means for bending projecting ends of the studs to a position generally parallel to said second strip, said bending means comprising a first shuttle mounting a series of fixed bending blades having a cam surface contacting the projecting stud ends, lateral movement of said shuttle and said blades effecting the bending of the projecting stud ends.

18. The apparatus of claim 17 wherein said bending means includes a pivot operator, a vertically movable rack connected to said operator, a shuttle end rack on said shuttle and gear means between said vertically movable rack and said shuttle end rack.

19. The apparatus of claim 18 including a second shuttle mounting bending blades, said shuttle being rack and gear connected to said first shuttle such that said first shuttle bends ones of the projecting stud ends in one direction and said second shuttle bends the remainder of the projecting stud ends in an opposite direction.

20. The apparatus of claim 18 in which said bending blades are bifurcated and include end portions for bending outboard and inboard portions of the projecting stud ends against said second strip.

21. The apparatus of claim 17 wherein said clamping means comprises a rotary pressure bar having a series of cantilevered fixed fingers extending therefrom, said fingers being rotatable with said pressure bar to contact the assemblage of strips and paper sheets stack.

22. The apparatus of claim 21 wherein said pressure bar includes a spiral cam channel and such clamping means further comprises a finger-operated linearly moveable slide bar, said slide bar having a fixed follower movable in said cam channel to rotate said pressure bar.

23. Apparatus for binding a stack of perforated paper sheets utilizing flexible studs projecting from a first strip placed on one side of a marginal edge of the paper sheets stack wherein the studs pass through the sheet perforations and project through holes in a second strip placed on the opposite side of the marginal edge of the paper sheets stack comprising:

a housing;

means in said housing for supporting an assemblage of the strips and the paper sheets stack with the second strip being supported by said housing;

clamping means for clamping the assemblage to said housing; and wherein said clamping means comprises a rotary pressure bar having a series of cantilevered fixed fingers extending therefrom, said fingers being rotatable with said pressure bar to contact the assemblage of strips and paper sheets stack.

24. The apparatus of claim 23 wherein said pressure bar includes a spiral cam channel and such clamping means further comprises a finger-operated linearly moveable slide bar, said slide bar having a fixed follower movable in said cam channel to rotate said pressure bar.

25. A combined punch and binding apparatus having a housing;

a hole punch mechanism in said housing and accessible to a stack of paper sheets insertable along a linear edge of the housing;

a punch operational crank pivotally connected to said housing;

means interconnecting said crank to said punch mechanism for operating said punch mechanism to punch a series of marginal apertures in a number of paper sheets; and a binding means extending from a side of said housing for binding a stack of punched paper sheets with a pair of plastic binding strips, one of said strips have a series of aligned apertures therein, the other of such strips including a series of flexible studs projecting therefrom, said studs being passed through the marginal apertures of a stack of sheets and through aligned apertures of said one strip ends of the studs projecting from the other strip being bendable into a groove in the one strip; and moveable bending means for bending the projecting stud ends, said bending means being interconnected to said operational crank such that up and down pivot movement of the crank moves said bending means laterally.

26. The apparatus of claim 25 in which said punch mechanism comprises a first punch means for punching round holes in paper sheets of a number accommodating the studs of the other strip and second punch means for punching rectangular holes in paper sheets, and accessible to a paper sheets stack insertable along a second linear edge of housing, said housing further including a second binding means extending from an opposite side of said housing for binding a stack of rectangular apertured paper sheets with a plastic binding unit having an elongated spine and integral spaced resilient curled fingers extending from the spine.

27. The apparatus of claim 26 in which said second binding means includes a finger-operated push block accessed in a top slot in said housing and including an orthogonal cam follower, a hook plate for uncurling the curled fingers to receive a stack of rectangularly apertured paper sheets on the fingers, said hook plate including an angular cam groove, for reception of said cam follower and wherein translatory movement of said push block movers said hook plate orthogonally to uncurl said fingers.

28. A binding apparatus comprising a housing; and a binding means extending from a side of said housing for binding a stack of rectangular apertured paper sheets with a plastic binding unit having an elongated spine and integrated spaced resilient curled fingers extending from the spine in which said binding means includes a finger-operated push block accessed in a top slot and in said housing including an orthogonal cam follower, a hook plate for uncurling the curled fingers to receive a stack of rectangularly apertured paper sheets on the fingers, said hook plate including an angular cam groove, for reception of said cam follower and wherein translatory movement of said push block moves said hook plate orthogonally to uncurl said fingers.

29. The apparatus of claim 28 herein said push block is movable along a linear shaft, and further includes a pair of spur gears, said gears being interconnected to aligned racks on said hook plate to provide non-cocking movement of said hook plate.

30. A binding apparatus comprising a housing:

a first punch means in said housing for punching a first stack of paper sheets with marginal holes of a first size, spacing and shape;

a second punch means in said housing for punching a second stack of paper sheets with marginal holes of a second size, spacing and shape;

a punch operational pivot crank pivotally connected to said housing for operating said first and second punch means;

a first binding station in said housing for binding the first stack of paper sheets including a first binding element including an element portion extending through the punched holes of the first stack of paper sheets;

a second binding station in said housing for binding the second stack of paper sheets including a second binding element including an element portion extending through the punch holes of the second stack of paper sheets; and wherein at least one of said binding stations is interconnected to said pivot crank to effect binding of a selected one of the stacks by a selected one of the binding elements.

31. Apparatus for binding a stack of paper sheets including an apparatus housing;

binding means in said housing for binding the stack of apertured paper sheets; and wherein said binding means comprises recess means for accepting a first binding strip having a series of holes generally corresponding in size and spacing to the apertures in a paper sheets stack placed thereon;

means for accepting a second binding strip having flexible studs projecting therefrom of a size and spacing generally corresponding to the holes in the first binding strip, the studs passing through the apertures in the paper sheets stack and through the first binding strip holes, with ends of the studs projecting from the first binding strip; and bending means in said housing for bending the stud ends, said bending means comprising at at least one movable bending blade positioned below the first binding strip and being laterally movable to bend each projecting stud end into an underside stud-holding groove in said first binding strip; and means for moving said at least one bending blade under said recess means.

32. The apparatus of claim 31 wherein said means for moving comprises a vertically moving rack, a first shuttle including a rack connected to said vertically moving rack and mounting one-half of a series of bending blades to move laterally in a first horizontal direction and a second shuttle including a rack gear-connected to said first shuttle rack for mounting a second one-half of said bending blades to move in an opposite second horizontal direction.

* * * * *

UNITED STATES PATENT AND TRADEMARK OFFICE

CERTIFICATE OF CORRECTION

PATENT NO. : 5,143,502

DATED : September 1, 1992

INVENTOR(S) : Rick J. Kaufmann and Loren D. Stirling

It is certified that error appears in the above-identified patent and that said Letters Patent is hereby corrected as shown below:

Col. 5, line 55, delete "arrow" and insert --arrows--.

Col. 6, line 10, delete "-" and insert --,--.

Col. 8, line 23, delete "aid" and insert --said--.

Signed and Sealed this

Ninth Day of November, 1993

*Attest:*

*Attesting Officer*

BRUCE LEHMAN

*Commissioner of Patents and Trademarks*